United States Patent [19]

Parker

[11] Patent Number: 4,469,235

[45] Date of Patent: Sep. 4, 1984

[54] CLOSURE WITH UPWARDLY EXTENDING TABS

[75] Inventor: Jeremy L. Parker, Lancaster, Pa.

[73] Assignee: Kerr Glass Manufacturing Corporation, Lancaster, Pa.

[21] Appl. No.: 532,175

[22] Filed: Sep. 14, 1983

[51] Int. Cl.[3] ..... B65D 43/38; B65D 43/40

[52] U.S. Cl. ..... 215/295; 215/302; 220/284

[58] Field of Search ..... 215/295, 302, 100 A; 220/284, 94 A

[56] References Cited

U.S. PATENT DOCUMENTS

| | | | |
|---|---|---|---|
| 2,408,233 | 9/1946 | Smith | 220/284 |
| 3,151,777 | 10/1964 | Rooney | 222/92 |
| 3,433,380 | 3/1969 | Kawchitch | 215/40 |
| 4,156,491 | 5/1979 | Lyon | 215/302 |
| 4,252,249 | 2/1981 | Beckhardt et al. | 220/284 |

*Primary Examiner*—George T. Hall

*Attorney, Agent, or Firm*—Fitch, Even, Tabin & Flannery

[57] ABSTRACT

A closure includes a plurality of tabs extending upwardly from its top wall to enable manual application of torque to the closure without gripping of the side wall thereof. The preferred tabs have surfaces defining a plane for supporting the closure in an inverted position for installation of a liner, and do not extend radially beyond the side wall of the closure.

12 Claims, 3 Drawing Figures

CLOSURE WITH UPWARDLY EXTENDING TABS

BACKGROUND OF THE INVENTION

The present invention relates generally to container closures and more particularly to a closure having internal threads for engagement with external threads of a container.

Various types of closures are presently made for threaded engagement with container necks. It is well known for a closure to be molded from plastic and to include a top wall and an internally threaded annular side wall depending therefrom.

Such closures typically include a seal to engage a rim at the top of the container neck. To obtain a satisfactory seal, pressure must be exerted upon the rim of the container neck by the seal. This pressure creates friction between the closure and the container neck which may make removal of the closure difficult.

Closures of this type are generally intended to be removed manually by gripping the side wall of the closure and twisting it relative to the container. To facilitate removal of the closure, the closure may have vertical ribs or the like disposed about its periphery on the side wall. However, some persons, such as arthritics, may be unable to comfortably grip the side wall and rotate the cap due to reduced strength and dexterity of their hands. In the past, such persons have commonly had to use tools or specialized devices to open containers sealed with conventional closures. There has been a need for a closure which may be rotated by a person with reduced manual dexterity without the use of such devices.

In providing an acceptable seal for a closure, the closure may be provided with a separately formed seal element of plastisol or a coated liner board. Alternatively, some closures are formed with an internal integral sealing rib and are termed linerless closures. With a closure having a separately formed liner, the latter is inserted as a separate piece against the lower surface of the top wall of the closure. Liners are commonly inserted by inverting the closure and pressing the liner downwardly into place against the upwardly facing lower surface of the top wall. To facilitate such insertion without requiring a specially configured surface to support the closure, it is desirable that a closure be capable of maintaining a stable mechanical equilibrium in an inverted position on a flat horizontal surface.

Another desirable feature in closures is to avoid having portions extending outwardly beyond the side wall. Where portions project radially outwardly beyond the side wall, there may be interference between adjacent closures when a plurality of closures are disposed side-by-side adjacent one another. This may also interfere with handling of the closures by conventional capping equipment.

SUMMARY OF THE INVENTION

In accordance with the present invention, a closure is provided which includes one or more tabs which extends upwardly from the top wall and which provides surfaces to enable application of torque to the closure without gripping of the side wall. Herein, the tabs are configured so that a plurality of closures may be positioned side-by-side without interference between tabs on adjacent closures, and include portions for supporting the closure stably in an inverted position on a flat horizontal surface.

Accordingly, it is a general object of the present invention to provide a novel and improved closure having means to facilitate application of torque thereto.

It is a more specific object of the present invention to provide a one-piece, molded closure providing pressure surfaces which may be engaged by the fingers of a user or by a fixed surface to facilitate application of torque thereto.

It is a further object of the present invention to provide a closure which may be used with conventional capping equipment for automatic installation on containers.

It is an additional object of the present invention to provide a closure which may be stably supported in an inverted position upon a flat horizontal surface.

DETAILED DESCRIPTION OF THE PREFERRED EMBODIMENT

Figure 1:
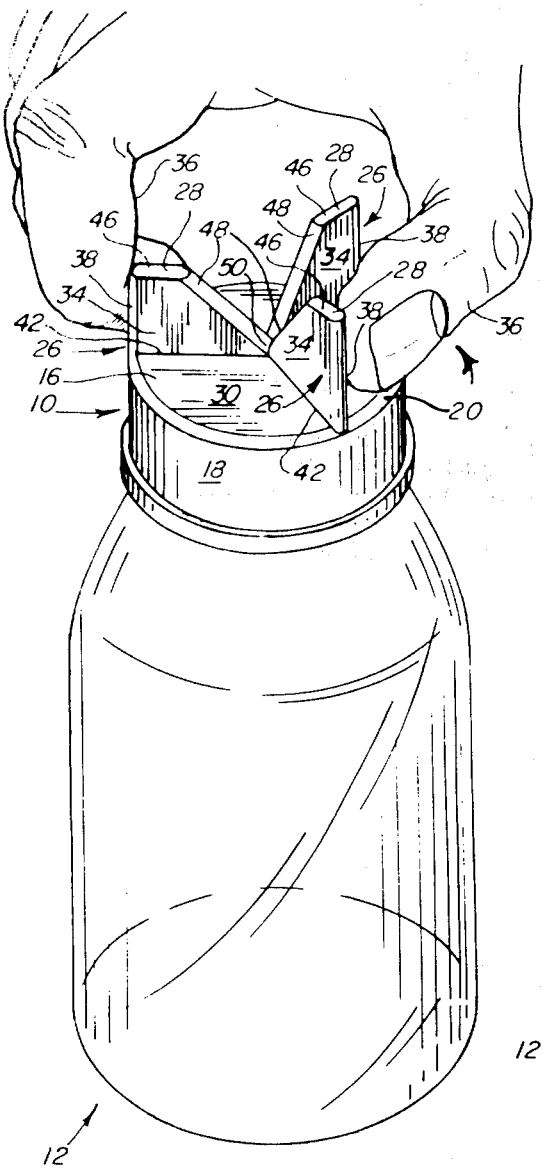
FIG. 1 is a perspective view illustrating the closure of the present invention in installed relation upon a container and illustrating a technique for manual rotation of the closure.

The present invention is generally embodied in a closure, indicated generally at 10, for sealing an open-topped container 12. The illustrated container 12 is of known configuration and includes a neck portion 14 having an external screw thread (not shown) formed thereupon and a circular rim (not shown) extending about its open top.

The closure 10 includes a top wall 16 for extending across the open top of the container 12 when the closure is in position on the container, and an annular side wall 18 integrally joined to the top wall about its periphery 20 and depending therefrom. The annular side wall 18 has an internal screw thread 22 formed on it for engagement with the external screw thread of the container 12. The top wall 16 and side wall 18 may be made of any suitable material and are preferably of molded plastic construction. The closure may include a liner 24 or other suitable seal for engagement with the rim about the open top of the container 12.

For certain users of products packaged in containers with screw-on closures, it may be difficult to grip the closure to provide adequate torque to remove the closure from the container. For example, arthritics suffering from reduced manual dexterity may have difficulty opening medicine containers and the like equipped with some conventional closures.

Figure 3:
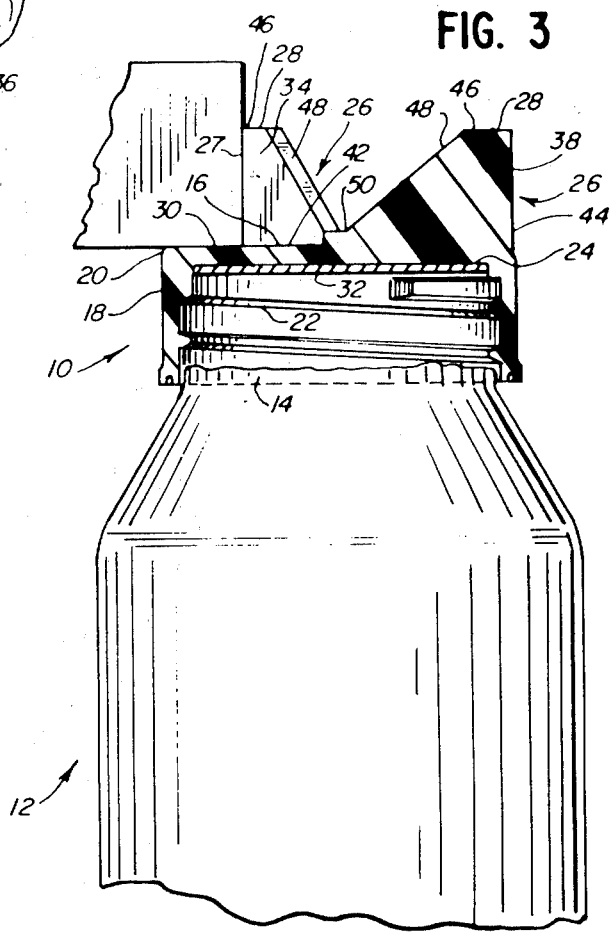
FIG. 3 is a sectional elevational view of the closure of FIG. 1 in an upright position, taken from an orientation 90° displaced from that of FIG. 2, showing the closure in installed relation upon a container.
Figure 2:
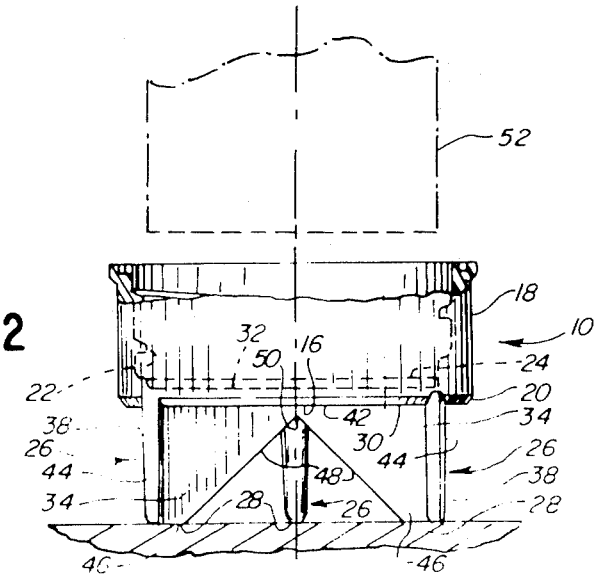
FIG. 2 is a side elevational view of the closure of FIG. 1 in an inverted position, shown partially in section and with portions broken away for clarity.

In accordance with the present invention, there is provided a closure 10 which includes one or more tabs 26 which extend upwardly from the top wall 16 to provide pressure surfaces 34 which enable torque to be applied manually to the closure 10 without the sidewall being gripped. The tabs 26 herein enable application of torque to the closure 10 by engagement of the tabs 26 either by the thumb and fingers 36 of a user (FIG. 1) or by a fixed surface 27, such as the edge of a counter (FIG. 3). Herein, the tabs 26 are configured so that a plurality of closures 10 may be positioned side-by-side without interference between tabs 26 on adjacent closures, and include portions 28 for supporting the closure 10 stably in an inverted position.

In the preferred embodiment, the top wall 16 has a generally circular periphery 20 defining a radius, and the annular side wall 18 is of generally circular cross-section, defining an axis through its center perpendicular to the top wall 16. While the side wall 18 is preferably generally cylindrical in shape, it is slightly tapered so that it decreases in diameter proceeding upward to facilitate its removal from a mold during manufacture.

The top wall 16 in the illustrated embodiment has a generally planar upper surface 30 and a generally planar lower surface 32. To facilitate manufacture of the closure 10, the tabs 26 are preferably molded integrally with the top wall 16 and extend perpendicularly upward from the planar upper surface 30 thereof. This enables the closure to be manufactured relatively inexpensively. To facilitate removal of the tabs 26 from a mold during manufacture, they may be tapered slightly in thickness, being of greatest thickness adjacent the top wall 16. To provide sufficient strength and rigidity within acceptable limits of material usage, the tabs 26 are preferably relatively thin and may have thicknesses of, for example, 0.094 inches adjacent the top wall 16, tapering to 0.083 inches adjacent the support surfaces 28. The opposite sides of the respective tabs provide pressure surfaces 34 which enable torque to be applied to the closure 10 in either direction without the side wall being gripped.

It will be appreciated that the mechanical advantage which may be obtained by one employing the tabs 26 to apply torque to the closure 10 is dependent upon the distance of the outermost portions 38 of the pressure surfaces 34 of the tabs 26 from the central axis of the closure 10. By increasing the distance between the outermost edges 38 of the respective tabs 26 and the central axis of the closure, the length of the effective moment arm may be increased to enable a greater amount of torque to be applied to the closure 10 by a given force applied to the tab 26.

It will further be appreciated that tabs or the like extending radially beyond the periphery of the top wall would cause interference when positioning a number of closures, or containers having closures thereon, side-by-side in a packing crate or the like. Although the illustrated container 12 is of generally circular cylindrical configuration with a radius larger than that of the closure 10, the closure 10 might be used on a container having flat sides or having a radius approximately equal to that of the closure 10. In the latter cases, packing of a number of containers side-by-side would position the side walls 16 of the closures in close proximity to, or in actual contact with one another.

To prevent interference between the tabs 26 on adjacent closures 10 while providing an acceptable mechanical advantage for application of torque to the closure 10 through the tabs 26, the tabs 26 in the preferred embodiment extend to the periphery 20 of the top wall 16 but do not extend beyond the periphery of the top wall. An additional advantage of this feature is that it enables the closure 10 to be handled by conventional capping equipment.

In the illustrated embodiment, each of the tabs 26 is positioned so as to extend substantially radially outward from the central axis of the closure 10. Each of the tabs 26 is substantially trapezoidal in shape, having a bottom 42 integral with the top wall 16, an outer edge 44 extending upward from the periphery 20 of the top wall and substantially perpendicular thereto, an upper edge 46 extending radially inward from the outer edge 46, and a sloping edge 48 extending downwardly and inwardly from the upper edge 46 to the center 50 of the top wall 16. The upper edges 46 of the respective tabs provide the support surfaces 28 when the closure 10 is inverted to support the closure in a stable position for receiving a tool 52 to press the liner 24 into place.

It is desirable that the tabs 26 be configured so that they may be comfortably enaged by the fingers and thumb 36 of a user or be pressed against the edge of a fixed surface 27 such as a counter top or table to enable torque to be applied to the closure. To these ends, the closure 10 herein includes three tabs 26 disposed at evenly spaced circumferential intervals about the top wall 16 with included angles of approximately 120° between adjacent pressure surfaces 34. Adequate pressure surface area for the tabs 26 is provided by forming the tabs with a height of about 0.39 inches. The closure may be engaged at one, two, or three of the tabs 26 by the fingers and thumb 36 of a user in any suitable manner, such as that illustrated in FIG. 1, for rotation of the closure in either a clockwise or counterclockwise direction relative to the container 12. In the alternative, torque may be applied to the closure 10 relative to the container 12 by grasping the container, pressing two of the tabs against a flat surface to restrain the closure against rotation, and subsequently rotating the container.

FIG. 3 illustrates use of a fixed surface 27 such as a projecting counter edge or table edge to constrain the closure 10 against rotation so that the container 12 may be opened by rotating it while it is held in an upright position. The container 12 might also be opened by positioning the closure 10 against a counter edge so that a pressure surface 34 lies flush against a fixed planar surface and rotating the container while using the engagement between the pressure surface 34 and the fixed surface to constrain the closure against rotation. Another way to apply torque to the closure would be to strike one of the tabs 26 against a corner or edge of a counter or the like.

The liner 24 may be made of any suitable material such as a laminated board made of paper stock having a layer of plastic facing away from the top wall 16 of the closure for sealing engagement with the rim of the container. The liner 24 may be held in place by any suitable means (not shown), such as hot melt adhesive disposed between the liner 24 and the top wall 16. The liner 24 for the closure 10 of the present invention may be installed by placing the closure 10 in an inverted position so that it is supported stably by the support surfaces 28, then placing a drop of hot melt adhesive (not shown) onto the upwardly facing lower surface 32 of the top wall 16, and finally pressing the liner 24 against the top wall 16 with a suitable tool 52. Alternatively, a ring of plastisol may be deposited onto the upwardly facing lower surface 32 of the top wall 16.

From the foregoing, it will be appreciated that the present invention provides a novel and improved closure which may be removed from or replaced upon a container by persons with reduced manual dexterity without the use of any tools or other devices for gripping the closure. While a preferred embodiment has been described and illustrated, there is no intent to limit the scope of the invention to this or any other particular embodiment.

What is claimed is:

1. A closure for sealing an open-topped container having an external screw thread, the closure comprising:

a top wall for extending across the open top of the container;

an annular side wall integrally joined to the top wall about the periphery of the top wall and depending therefrom, and having an internal screw thread formed on it for engagement with the external screw thread of the container; and means to facilitate rotation of the cap comprising a plurality of tabs extending upwardly from the top wall of the cap providing a plurality of surfaces which may be engaged to apply torque to the cap;

the annular side wall having an outer surface which includes a portion of generally circular cross section defining a maximum radius for the closure.

2. A closure in accordance with claim 1 further comprising a liner positioned beneath the top wall and affixed thereto.

3. A closure in accordance with claim 2 wherein the tabs include support surfaces defining a plane for supporting the closure in an inverted position upon a flat surface.

4. A closure in accordance with claim 1 wherein the tabs are joined at the center of the top wall of the closure and extend radially outwardly therefrom.

5. A closure in accordance with claim 1 wherein each of the tabs extends to about 0.39 inches from the top wall.

6. A closure for sealing an open-topped container having an external screw thread, the closure comprising:

a top wall having a generally planar lower surface;

an annular side wall integrally joined to the top wall about the periphery of the top wall and depending therefrom, the annular side wall defining an axis perpendicular to the top wall and having an internal screw thread formed on it for engagement with the external screw thread of the container; and a plurality of tabs extending upwardly from the top wall of the closure, the tabs including one or more support surfaces defining a plane substantially parallel to the lower surface of the top wall for supporting the closure in an inverted position upon a flat surface, and including pressure surfaces for enabling torque to be applied to the closure without the annular side wall of the closure being gripped.

7. A closure in accordance with claim 6 wherein the top wall has a generally circular periphery defining a radius, and wherein each of the tabs extends radially outward from the axis defined by the annular side wall and has a radial dimension approximately equal to the radius defined by the periphery of the top wall.

8. A closure in accordance with claim 6 further comprising a liner positioned beneath the top wall and affixed thereto.

9. A closure in accordance with claim 8 wherein the liner is affixed to the top wall by a hot melt adhesive.

10. In combination, an open-topped container having an external screw thread and a one-piece plastic closure for sealing the container, the closure comprising:

a top wall for extending across the open top of the container, the top wall having generally planar upper and lower surfaces;

an annular side wall integrally joined to the top wall about the periphery of the top wall and depending therefrom, and having an internal screw thread formed on it for engagement with the external screw thread of the container;

a liner positioned beneath the top wall and affixed thereto; and means to facilitate rotation of the cap comprising three tabs extending upwardly from the upper surface of the top wall of the cap and extending radially outward from the center of the top wall to the periphery thereof, each tab having approximately planar pressure surfaces on its opposite sides, the tabs being evenly spaced about the top wall so that the included angle between adjacent pressure surfaces on each pair of tabs is approximately 120°;

each of the tabs being generally trapezoidal in shape, and having an uppermost portion, the uppermost portions of the respective tabs collectively defining a plane substantially parallel to the lower surface of the top wall of the closure so that the closure may be supported by the tabs in an inverted position upon a flat surface with the lower surface of the top wall oriented generally parallel to the flat surface.

11. A combination in accordance with claim 10 wherein each of the approximately planar surfaces of the tabs is perpendicular to the upper surface of the top wall of the closure.

12. A combination in accordance with claim 11 wherein the uppermost portions of the tabs are approximately 0.39 inches from the upper surface of the top wall.

* * * * *